US010158163B2

(12) United States Patent
Gang et al.

(10) Patent No.: US 10,158,163 B2
(45) Date of Patent: Dec. 18, 2018

(54) MOBILE TERMINAL

(71) Applicant: LG ELECTRONICS INC., Seoul (KR)

(72) Inventors: Cheolgu Gang, Seoul (KR); Hyunsuk Yang, Seoul (KR); Jongmo Kang, Seoul (KR); Jinho Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 42 days.

(21) Appl. No.: 15/241,605

(22) Filed: Aug. 19, 2016

(65) Prior Publication Data

US 2017/0054199 A1 Feb. 23, 2017

(30) Foreign Application Priority Data

Aug. 20, 2015 (KR) ..... 10-2015-0117416

(51) Int. Cl.
*H01Q 21/28* (2006.01)
*H01Q 1/24* (2006.01)

(52) U.S. Cl.
CPC ..... *H01Q 1/243* (2013.01); *H01Q 21/28* (2013.01)

(58) Field of Classification Search
CPC ..... H01Q 1/243; H01Q 21/28
See application file for complete search history.

(56) References Cited

U.S. PATENT DOCUMENTS 8,947,302 B2 * 2/2015 Caballero ..... H01Q 1/243 343/702
2008/0079651 A1 * 4/2008 Kim ..... H01Q 1/243 343/872
2010/0302110 A1 * 12/2010 Leem ..... H01Q 1/243 343/702
2011/0165916 A1 * 7/2011 Park ..... H01Q 1/06 455/566
2011/0273340 A1 * 11/2011 Jeon ..... H01Q 1/243 343/702
2013/0321219 A1 * 12/2013 Cho ..... H01Q 1/243 343/702
2014/0139379 A1 * 5/2014 Bolin ..... H01Q 1/243 343/702
2014/0225787 A1 8/2014 Ramachandran et al.
2015/0009075 A1 1/2015 Lau et al.
(Continued)

OTHER PUBLICATIONS

International Search Report and Written Opinion issued in PCT/KR2016/008106 dated Nov. 9, 2016.

*Primary Examiner* — Hoang Nguyen
*Assistant Examiner* — Awat Salih
(74) *Attorney, Agent, or Firm* — KED & Associates, LLP

(57) ABSTRACT

Disclosed is a mobile terminal, by which extensibility of an antenna pattern and radiation efficiency of an antenna can be increased. The present invention includes a display, a frame configured to support a back of the display, a first antenna to be provided to at least one side of a top portion and a bottom portion of the frame, a rear case to attach to a back of the frame, a second antenna provided to at least one of an inner side and an outer side of the rear case, and a third antenna configured in a beam shape to be attached to at least one of a right lateral side and a left lateral side of the frame, the third antenna configured to be electrically connected to either the first antenna or the second antenna.

18 Claims, 14 Drawing Sheets

(56) References Cited

U.S. PATENT DOCUMENTS

| | | | | |
|---|---|---|---|---|
| 2015/0155614 | A1* | 6/2015 | Youn | H04M 1/0249<br>343/702 |
| 2015/0181005 | A1* | 6/2015 | Yun | H04M 1/026<br>455/575.7 |
| 2016/0088130 | A1* | 3/2016 | Jung | G06F 1/1626<br>455/575.1 |
| 2016/0315651 | A1* | 10/2016 | Hong | H04B 1/3888 |

* cited by examiner (a)

(b)

MOBILE TERMINAL

CROSS-REFERENCE TO RELATED APPLICATION

This application claims priority to Korean Patent Application No. 10-2015-0117416 filed on Aug. 20, 2015, in Korea, the entire contents of which is hereby incorporated by reference in its entirety.

BACKGROUND OF THE INVENTION

Field of the Invention

The present invention relates to a mobile terminal. Although the present invention is suitable for a wide scope of applications, it is particularly suitable for a mobile terminal having an antenna.

Discussion of the Related Art

Generally, an antenna plays a role in transmitting or receiving wireless signals. The antenna fails to receive incoming signals in all directions with the same performance. Instead, reception performance of the antenna varies depending on a direction and angle of an incoming signal.

Several limitations are put on an antenna installed in a mobile terminal.

In order to satisfy a specific frequency range in a small space, an antenna pattern in a predetermined size or bigger is required. Yet, it is difficult to extend an antenna due to the limited volume and space of a mobile terminal.

In order to have a high signal transmitting/receiving rate, it is necessary for an antenna to be configured in a most outer region of a mobile terminal without being blocked by other members of the mobile terminal. Yet, it is difficult to achieve such a configuration due to the limited space. When a user grips an antenna exposed region with fingers, a problem of an electric shock to the user and a problem of a degraded radiation capability due to an unintended ground effect and the like may be caused.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Figure 1A:
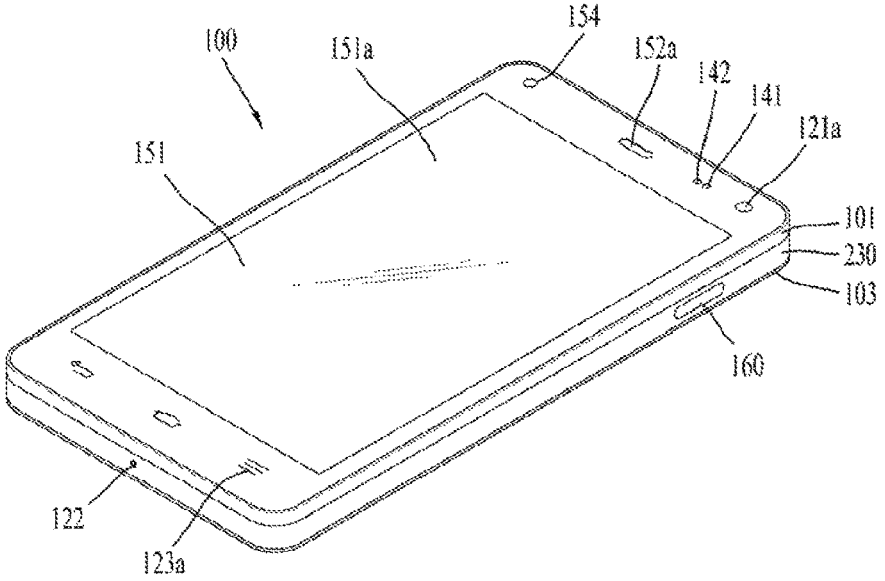
FIG. 1A and FIG. 1B are conceptual diagrams for one example of a mobile terminal according to the present invention viewed in different direction, respectively.
Figure 1B:
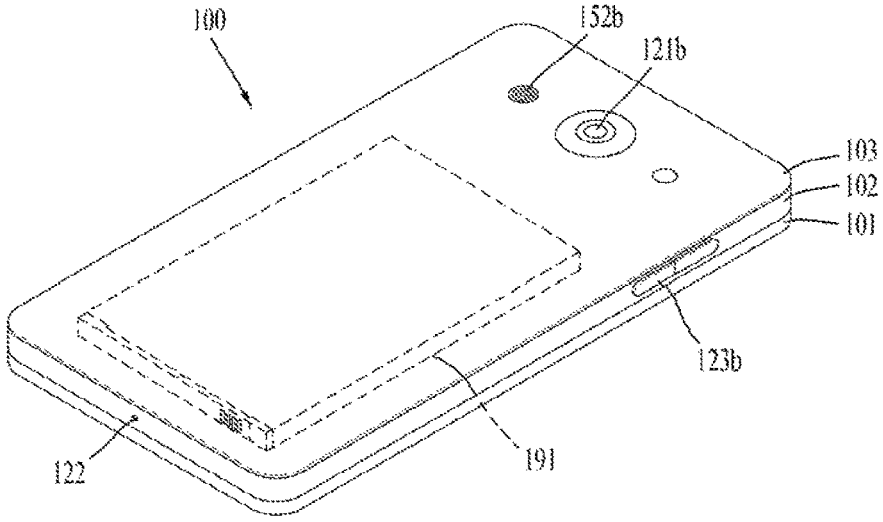

Referring now to FIGS. 1A and 1B, the mobile terminal 100 is described with reference to a bar-type terminal body. However, the mobile terminal 100 may alternatively be implemented in any of a variety of different configurations. Examples of such configurations include watch-type, clip-type, glasses-type, or as a folder-type, flip-type, slide-type, swing-type, and swivel-type in which two and more bodies are combined with each other in a relatively movable manner, and combinations thereof. Discussion herein will often relate to a particular type of mobile terminal (for example, bar-type, watch-type, glasses-type, and the like). However, such teachings with regard to a particular type of mobile terminal will generally apply to other types of mobile terminals as well.

The mobile terminal 100 will generally include a case (for example, frame, housing, cover, and the like) forming the appearance of the terminal. In this embodiment, the case is formed using a front case 101 and a rear case 230. Various electronic components are incorporated into a space formed between the front case 101 and the rear case 230. At least one middle case may be additionally positioned between the front case 101 and the rear case 230.

The display 151 is shown located on the front side of the terminal body to output information. As illustrated, a window 151*a* of the display 151 may be mounted to the front case 101 to form the front surface of the terminal body together with the front case 101.

In some embodiments, electronic components may also be mounted to the rear case 230. Examples of such electronic components include a detachable battery 191, an identification module, a memory card, and the like. Rear cover 103 is shown covering the electronic components, and this cover may be detachably coupled to the rear case 230. Therefore, when the rear cover 103 is detached from the rear case 230, the electronic components mounted to the rear case 230 are externally exposed.

As illustrated, when the rear cover 103 is coupled to the rear case 230, a side surface of the rear case 230 is partially exposed. In some cases, upon the coupling, the rear case 230 may also be completely shielded by the rear cover 103. In some embodiments, the rear cover 103 may include an opening for externally exposing a camera 121*b* or an audio output module 152*b*.

The cases 101, 230, 103 may be formed by injection-molding synthetic resin or may be formed of a metal, for example, stainless steel (STS), aluminum (Al), titanium (Ti), or the like.

As an alternative to the example in which the plurality of cases form an inner space for accommodating components, the mobile terminal 100 may be configured such that one case forms the inner space. In this example, a mobile terminal 100 having a uni-body is formed in such a manner that synthetic resin or metal extends from a side surface to a rear surface.

If desired, the mobile terminal 100 may include a waterproofing unit (not shown) for preventing introduction of water into the terminal body. For example, the waterproofing unit may include a waterproofing member which is located between the window 151*a* and the front case 101, between the front case 101 and the rear case 230, or between the rear case 230 and the rear cover 103, to hermetically seal an inner space when those cases are coupled.

In a following description, the mobile terminal 100 including the display 151, the first audio output unit 152*a*, the proximity sensor 141, the illumination sensor 142, the optical output unit 154, the first camera 121*a*, the first manipulating unit 123*a*, the second manipulating unit 123*b*, the microphone 122, the interface unit 160, the second audio output unit 152*b*, and the second camera 121*b*, as shown in FIG. 1A and FIG. 1B, is taken as one example. In particular, the display 151, the first audio output unit 152*a*, the proximity sensor 141, the illumination sensor 142, the optical output unit 154, the first camera 121*a*, and the first manipulating unit 123*a* are disposed on the front surface of the terminal body, the second manipulating unit 123*b*, the microphone 122 and the interface unit 160 are disposed on the lateral surface of the terminal body, and the second audio output unit 152*b* and the second camera 121*b* are disposed on the rear surface of the terminal body.

However, it is to be understood that alternative arrangements are possible and within the teachings of the instant disclosure. Some components may be omitted or rearranged. For example, the first manipulation unit 123*a* may be located on another surface of the terminal body, and the second audio output module 152*b* may be located on the side surface of the terminal body.

At least one antenna for wireless communication may be located on the terminal body. The antenna may be installed in the terminal body or formed by the case. For example, an antenna which configures a part of the broadcast receiving module may be retractable into the terminal body. Alternatively, an antenna may be formed using a film attached to an inner surface of the rear cover 103, or a case that includes a conductive material.

A power supply unit 190 for supplying power to the mobile terminal 100 may include a battery 191, which is mounted in the terminal body or detachably coupled to an outside of the terminal body.

The battery 191 may receive power via a power source cable connected to the interface unit 160. Also, the battery 191 can be recharged in a wireless manner using a wireless charger. Wireless charging may be implemented by magnetic induction or electromagnetic resonance.

The rear cover 103 is shown coupled to the rear case 230 for shielding the battery 191, to prevent separation of the battery 191, and to protect the battery 191 from an external impact or from foreign material. When the battery 191 is detachable from the terminal body, the rear case 103 may be detachably coupled to the rear case 230.

An accessory for protecting an appearance or assisting or extending the functions of the mobile terminal 100 may also be provided on the mobile terminal 100. As one example of an accessory, a cover or pouch for covering or accommodating at least one surface of the mobile terminal 100 may be provided. The cover or pouch may cooperate with the display 151 to extend the function of the mobile terminal 100. Another example of the accessory is a touch pen for assisting or extending a touch input to a touch screen.

Figure 2:
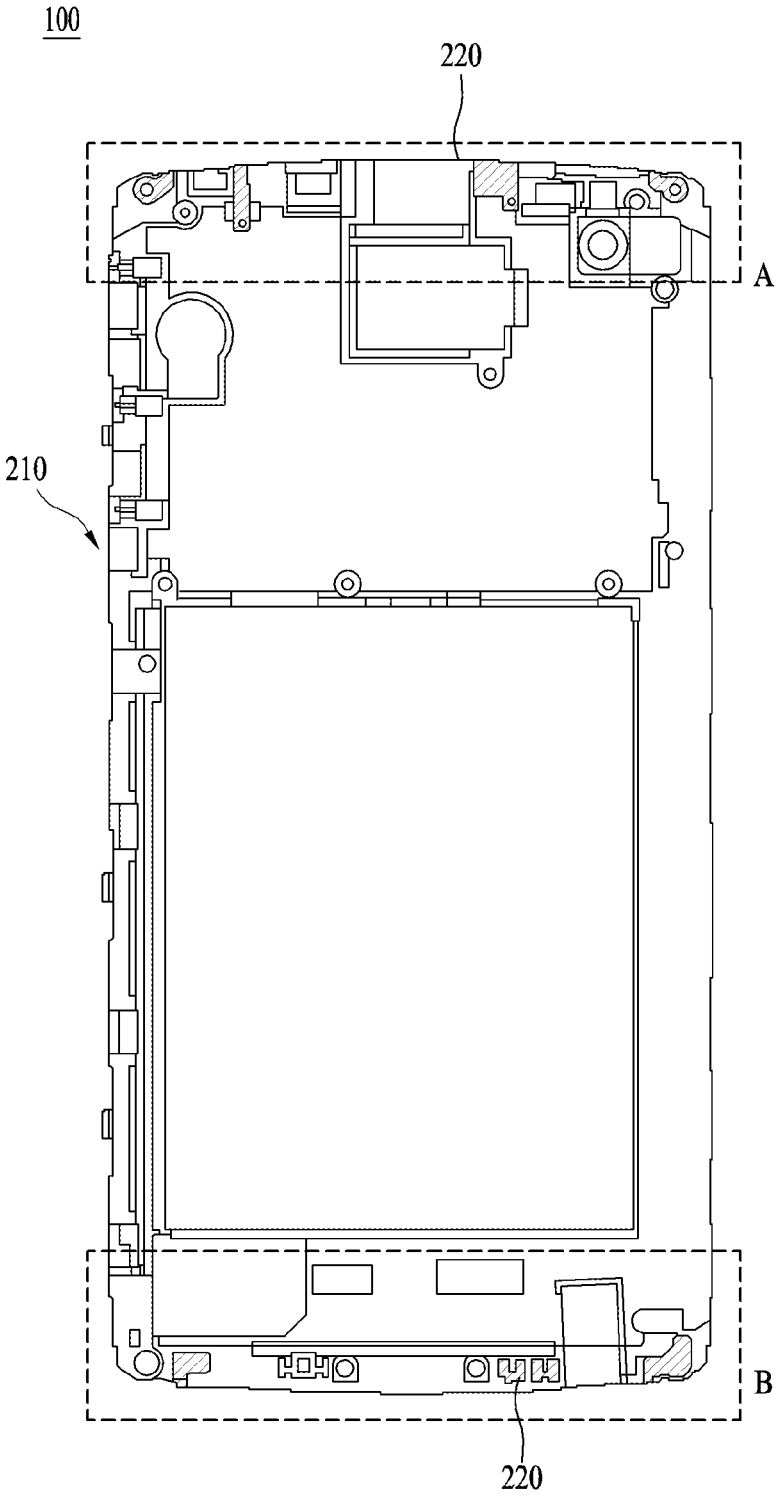
FIG. 2 is a diagram of a rear side of a frame exposed mobile terminal according to the present invention.

FIG. 2 is a diagram of a rear side of the mobile terminal 100 having a frame 210 exposed according to the present invention.

Referring to FIG. 2, the frame 210 can support a back of the display. It is enough for the frame 210 to provide a space in which an antenna supposed to be located at top and bottom portions of the mobile terminal 100 can be installed. And, the frame 210 is non-limited by a specific part name. Hence, the frame 210 may include the front case 101 mentioned in the foregoing description with reference to FIG. 1B.

A first antenna 220 may be provided to at least one of a top portion and a bottom portion of the frame 210. In particular, the first antenna 220 may be provided to either the top portion of the frame 210 or the bottom portion of the frame 210 or to both of the top and bottom portions of the frame 210, as needed.

Figure 3:
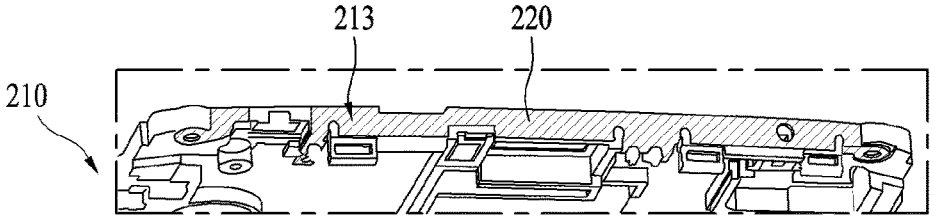
FIG. 3 is a perspective diagram for the regions A and B shown in FIG. 2.
Figure 3:
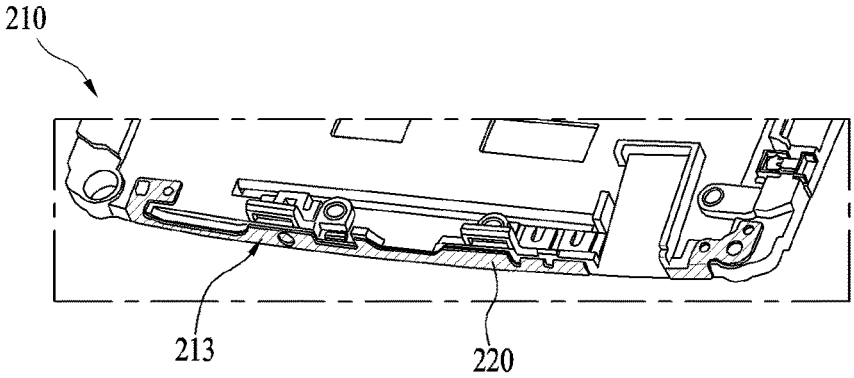

FIG. 3 is a perspective diagram for the regions A and B shown in FIG. 2.

Referring to FIG. 3, assuming that a multitude of patterns capable of performing a function of an antenna exists, it is necessary for the antenna patterns to be spaced apart from each other as distant as possible in order to perform their radiation functions most effectively. Moreover, when an antenna is provided to an edge of a mobile terminal, and more particularly, to an outer region of the mobile terminal, it is able to perform an effective radiation function. Hence, the top or bottom portion of the frame 210 at which the first antenna 220 is located may mean a most outer region of the mobile terminal 100.

Based on the above description, the top or bottom portion of the frame 219 in which the first antenna 220 is installed indicates the corresponding tendency only, and its shape, location or figure may be changed if necessary. Most of a pattern region of the first antenna 220 may be provided to a top or bottom surface of the frame 210.

The first antenna 220 may be formed of a conductive material. The first antenna 220 may have a pattern varying according to a bandwidth for radio transmission and reception.

The first antenna 220 may be provided in form of a flexible board. The first antenna 220 and the frame 210 may be assembled together through a hook provided to the frame 210 and a hook recess provided to the first antenna 220.

Alternatively, the first antenna 220 and the frame 210 are fixed to each other through a screw. The screw fixation shall be described in detail later.

Figure 4:
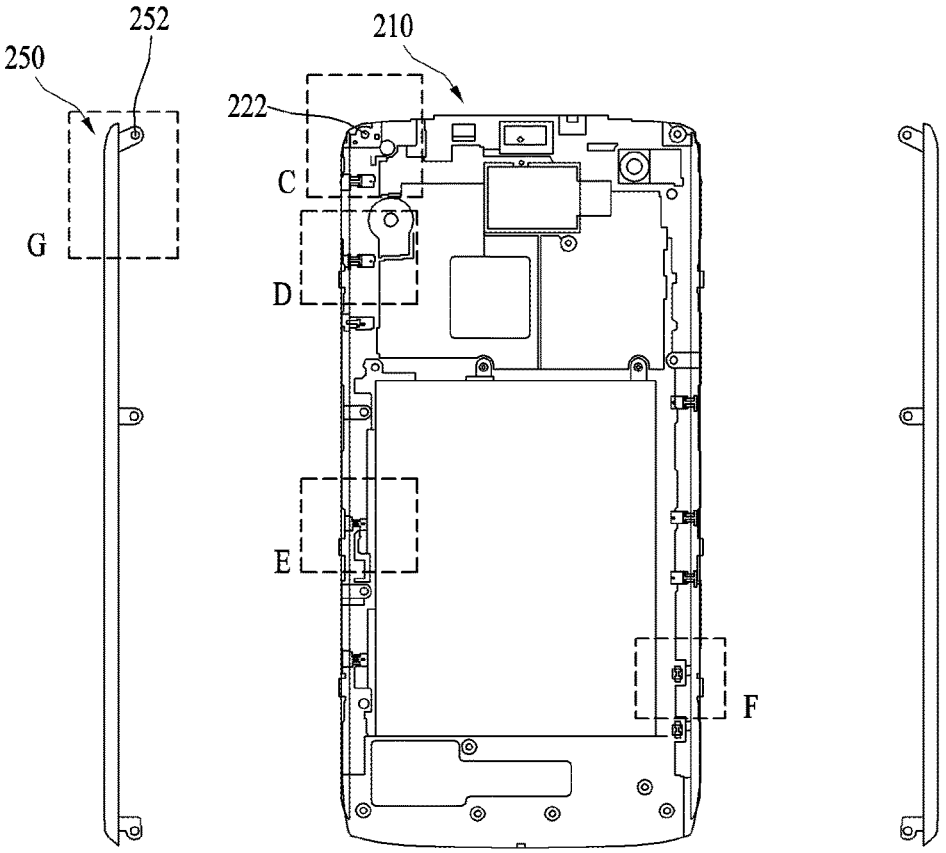
FIG. 4 is a diagram to describe a state before assembling a third antenna and a frame.

FIG. 4 is a diagram to describe a state before assembling a third antenna 250 and a frame 210.

Referring to FIG. 4, the third antenna 250 may include a beam shape formed of a conductive material. Particularly, the third antenna 250 may be formed of a metal material.

The third antenna 250 may be attached to right and left lateral surfaces of the frame 210. Yet, the third antenna 250 may be provided to either the right lateral surface or the left lateral surface of the frame 210 as needed. The third antenna 250 attached to the right and left lateral surfaces of the frame 210 may configure a portion of an exterior of the mobile terminal by being exposed through right and left lateral surfaces of the mobile terminal.

The third antenna 250 is named according to its function only and is non-limited by a shape of a related art antenna. Since the third antenna 250 configures the exterior of the mobile terminal 100, it is able to configure a natural overall exterior by having a shape continuous with the rest of the exterior of the mobile terminal 100.

Figure 5:
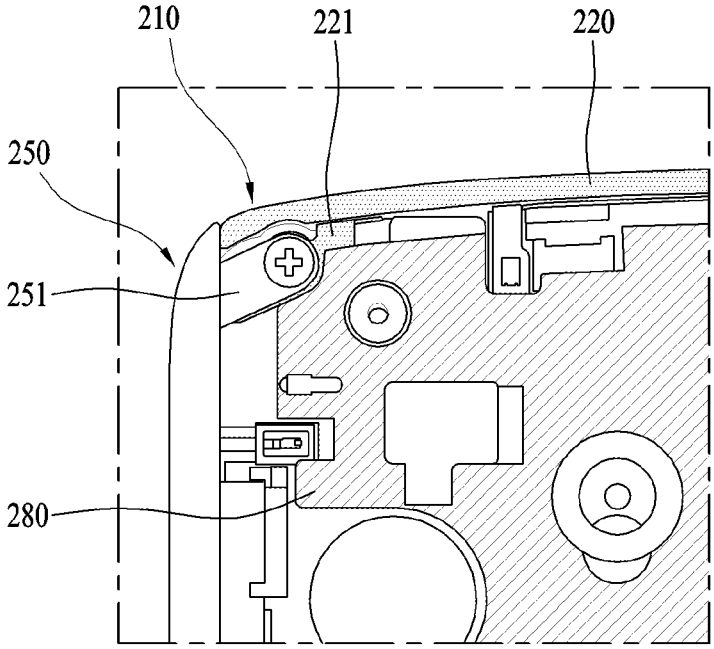
FIG. 5 is an enlarged diagram of a region C shown in FIG. 4.

FIG. 5 is an enlarged diagram of a region C shown in FIG. 4.

Referring to FIG. 5, the third antenna 250 may include a fixing part 251 projected by extending from an inner lateral surface. The fixing part 251 may be formed of a conductive material. In particular, the fixing part 251 may include a thin metal plate in which a first lock hole 252 shown in FIG. 4 is formed.

The first antenna 220 may include an extension part 221 configured to contact the fixing part 251 of the third antenna 250. As a second lock hole 222 shown in FIG. 4 is formed in the extension part 221 of the first antenna 220, it may overlap with the first lock hole 252 (shown in FIG. 4) pf the fixing part 251. The extension part 221 of the first antenna 220 can play a role as a ground by being electrically connected to the third antenna 250 and is also able to play a role in preventing a short circuit.

The frame 210 may include a fixing hole configured to overlap with each of the first lock hole 252 shown in FIG. 4 and the second lock hole 222 shown in FIG. 4. A screw is inserted in the first lock hole 252 shown in FIG. 4, the second lock hole 222 shown in FIG. 4 and the fixing hole, thereby assembling them together. Hence, such an assembly can raise the reliability of the contact between the first antenna 220 and the third antenna 250.

Through such a screw lock, the third antenna 250 can be fixed to the frame 210.

Figure 6:
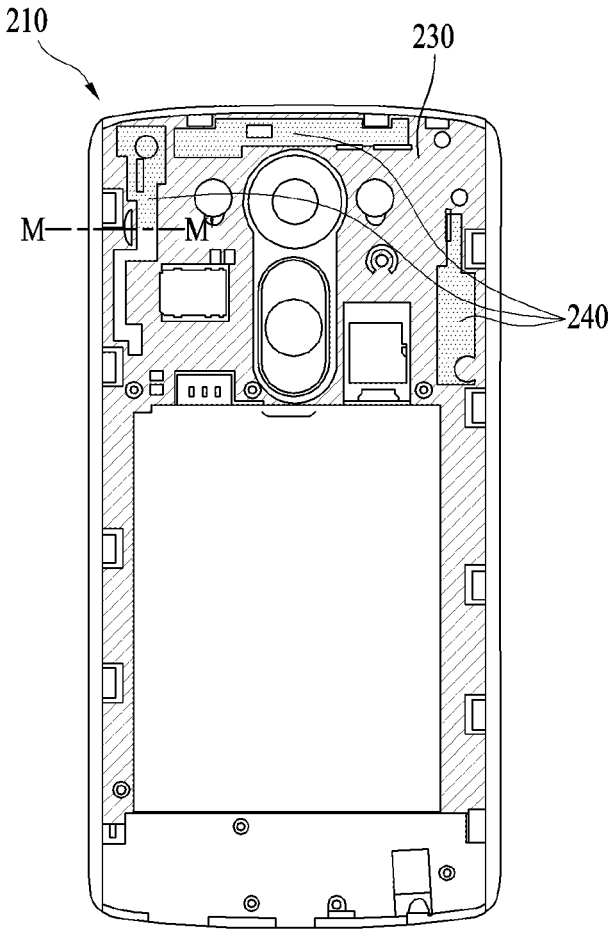
FIG. 6 is a diagram of a rear side of a rear case exposed mobile terminal according to the present invention.

FIG. 6 is a diagram of a rear side of the mobile terminal 100, of which rear case 230 is exposed, according to the present invention.

Referring to FIG. 6, the rear case 230 may be attached to a back of the frame 210. The rear case 230 may be directly attached to at least one predetermined region of the back of the frame. In some cases, the rear case 230 and the frame 210 may be indirectly assembled together through a prescribed member inserted between the frame 210 and the rear case 230.

A second antenna 240 formed of a conductive material in a pattern different from that of the first antenna 220 shown in FIG. 3 may be provided to at least one of an inner lateral surface and an outer lateral surface of the rear case 230.

The second antenna 240 may be provided to an outer lateral surface of the rear case for the purpose of antenna performance. Alternatively, the second antenna 240 may be provided to an inner lateral surface of the rear case 230 for the purpose of connection to the third antenna 250, which will be described later. To meet both of the purposes, the second antenna 240 may be provided to both of the outer latera surface and the inner lateral surface of the rear case 230, which will be described in detail later.

The first antenna 220 and the second antenna 240 play different roles, respectively. Particularly, the second antenna 240 may be configured with a multitude of different patterns spaced apart from each other.

In particular, the second antenna 240 may be configured with 3 antenna patterns spaced apart from one another as needed. The 3 antenna patterns of the second antenna 240 can play roles as a GPS antenna, an MIMO antenna, and a short range wireless communication antenna, respectively.

The second antenna 240 collectively indicates antennas provided to the rear case 230 and is non-limited by functionality or pattern shapes of the specific antennas mentioned in the foregoing description.

In order to facilitate the connection to the third antenna 250 provided to the lateral side of the mobile terminal 100, which will be described later, the second antenna 240 may be provided closer to a right or left side of the rear case 230.

Figure 7:
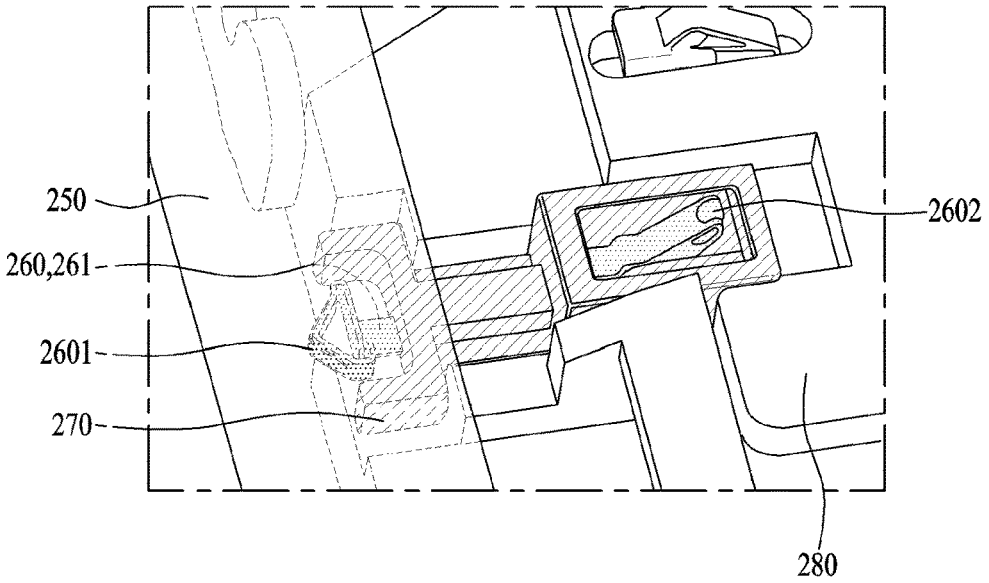
FIGS. 7 to 9 are diagram of several types of a connecting pin according to one embodiment of the present invention.
Figure 8:
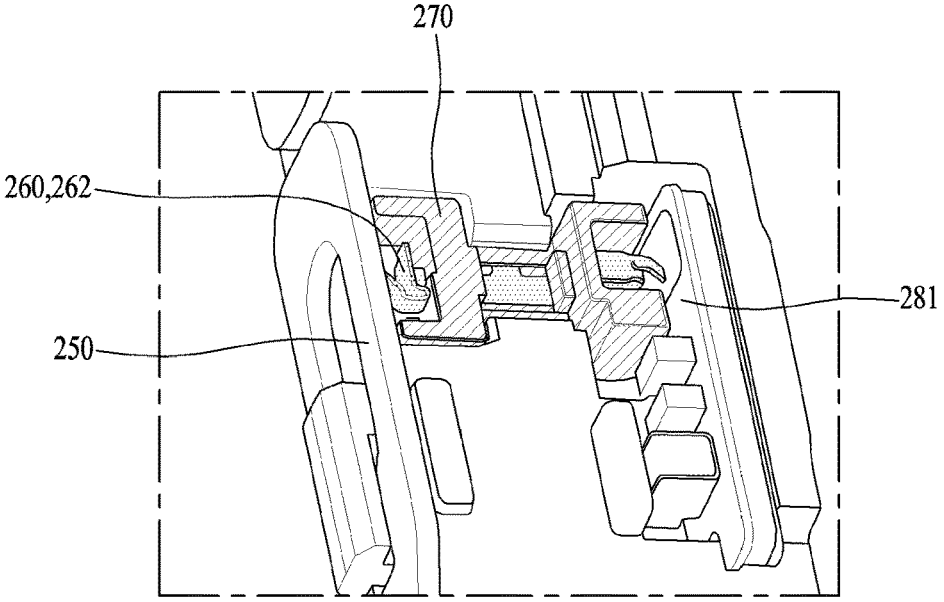
Figure 9:
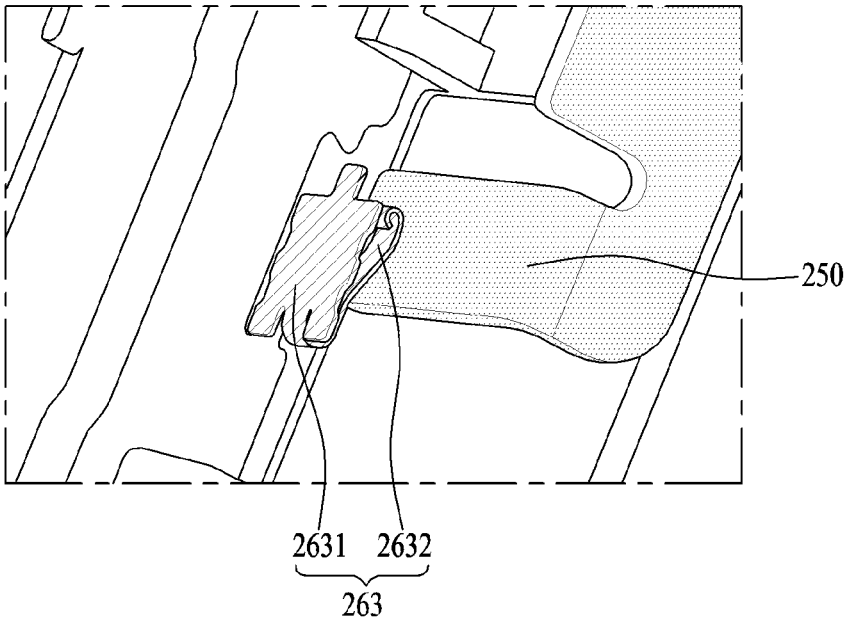

FIGS. 7 to 9 are diagram of several types of a connecting pin 260 according to one embodiment of the present invention.

Referring to FIGS. 7 to 9, a connecting pin 260 may play a role in connecting the third antenna 250 and the second antenna 240, a role in connecting the third antenna 250 and the main board 280, or a role in connecting the third antenna 250 and the flexible board 281. According to a structural shape for the connection, the connecting pin 260 may be classified into a vertical connecting point 261, a straight connecting pin 262 or a contact connecting pin 263.

A first end portion 2601 and a second end portion 2602 of the connecting pin 260 may include a metal wire of a bent terminal. The bent terminal can be elastically bent by a force applied in a predetermined range by working in a direction opposite to a projected direction. Hence, if the third antenna 250 presses a first end portion 2601 of the connecting pin 260 or the second antenna 240 presses a second end portion 2602 of the connecting pin 260, compression is enabled as much as the predetermined range, thereby connecting another member stably.

The connecting pin 260 may include a mold part 270 to be combined with the frame 210. A shape corresponding to an exterior of the mold part 270, a recess part is formed in the frame 210 so that the connecting pin 260 can be stuck therein. The mold part 270 may be formed by performing double injection molding on a metal wire. Alternatively, after a metal wire has been stuck in the mold part 270, the one end 2601 and the other end 2602 are bent to form a final shape of the connecting pin 260.

In case that the connecting pin 260 is fixable without the mold part 270, the third antenna 250 and other members can be connected using the connecting pin 260 only.

FIG. 7 is a rear perspective diagram of the region D shown in FIG. 4.

Referring to FIG. 7, the vertical connecting pin 261 may play a role in connecting the third antenna 250 to a different member vertically. In this case, the different member may include one of the second antenna 240, the main board 280 and the like. The third antenna 250 faces inward from the lateral side of the mobile terminal 100 and the member such as the second antenna 240, the main board 280 and the like faces inward from the rear side of the mobile terminal 100, whereby contact surfaces vertical to each other are provided. Hence, through the vertical connecting pin 261, an inner lateral surface of the third antenna 250 and an inner lateral surface of the different member can be connected to each other.

FIG. 8 is a rear perspective diagram of the region E shown in FIG. 4.

Referring to FIG. 8, if an inner lateral surface of the third antenna 250 and a prescribed surface of a different member face each other, the straight connecting pin 262 can play a role in connecting them. In this case, the different member may include a flexible board 281 connected to the main board 280 shown in FIG. 5.

FIG. 9 is a rear perspective diagram of the region F shown in FIG. 4.

Referring to FIG. 9, when a prescribed surface of the third antenna 250 and a prescribed surface of a connected different member face each other, if the straight connecting pin 262 is located closer than a necessary predetermined distance, it is able to use the contact connecting pin 263. In this case, the different member may include the main board 280 or the like. The contact connecting pin 263 may include a contact surface 2631 and an elastic part 2632 extending to form a predetermined inclination to the contact surface 2631 by being connected to one end portion of the contact surface 2631. Since one end portion of the elastic part 2632 is connected to the contact surface 2631, compression in a predetermined distance can be performed by elasticity of a material.

The vertical connecting pin 261, the straight connecting pin 262 and the contact connecting pin 263 differ from each other in accordance with dispositions of the connected members but almost have no difference in aspect of antenna functionality. Hence, each of the connecting pins 260 mentioned in the following description can be substituted with another connecting pin 260 as needed.

Figure 10:
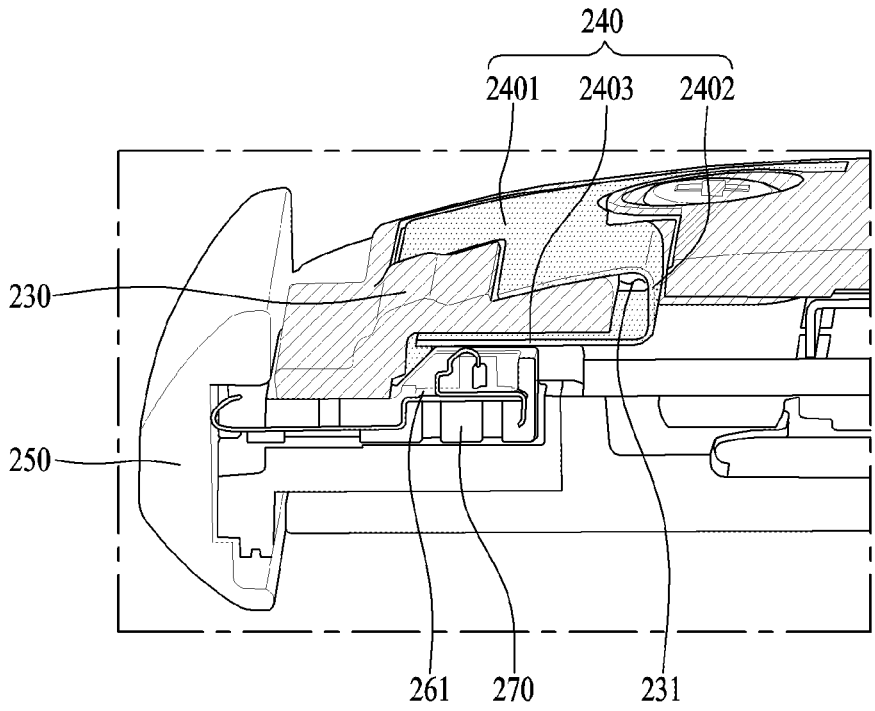
FIG. 10 is a cross-sectional diagram according to a direction M-M' shown in FIG. 6.

FIG. 10 is a cross-sectional diagram according to a direction M-M' shown in FIG. 6.

Referring to FIG. 10, in case of connecting the third antenna 250 and the second antenna 240 using the vertical connecting pin 261, since the third antenna 250 is located inside the rear case 230 and the second antenna 240 is provided to an outer lateral surface of the rear case 230, the rear case 230 may include a hole 231 configured to connect the vertical connecting pin 261 and the second antenna 240 to each other. The second antenna 240 includes a bent part 2402 configured to pass through the rear case hole 231 by being connected to an outer lateral surface part 2401. And, the bent part 2402 is connected to an inner lateral part 2403, whereby the inner lateral part 2403 can electrically come in contact with the vertical connecting pin 261.

In particular, in case that the mobile terminal 100 is virtually divided into 3 layers (i.e., first to third layers) from a front direction to a rear direction, the first antenna 220 is provided to a top or bottom portion in the first layer, the third antenna 250 is provided to right and left parts in the second layer, and the third antenna 250 is provided toward the rear surface of the mobile terminal 100 in the third layer.

Thus, the provided first, second and third antennas 220, 240 and 250 can be electrically connected all.

As the first, second and third antennas 220, 240 and 250 are electrically connected to each other, the degree of freedom of a region for forming a pattern increases. Moreover, as an antenna pattern region configured to be externally exposed increases, it may be able to obtain more effective radiation efficiency.

Figure 11:
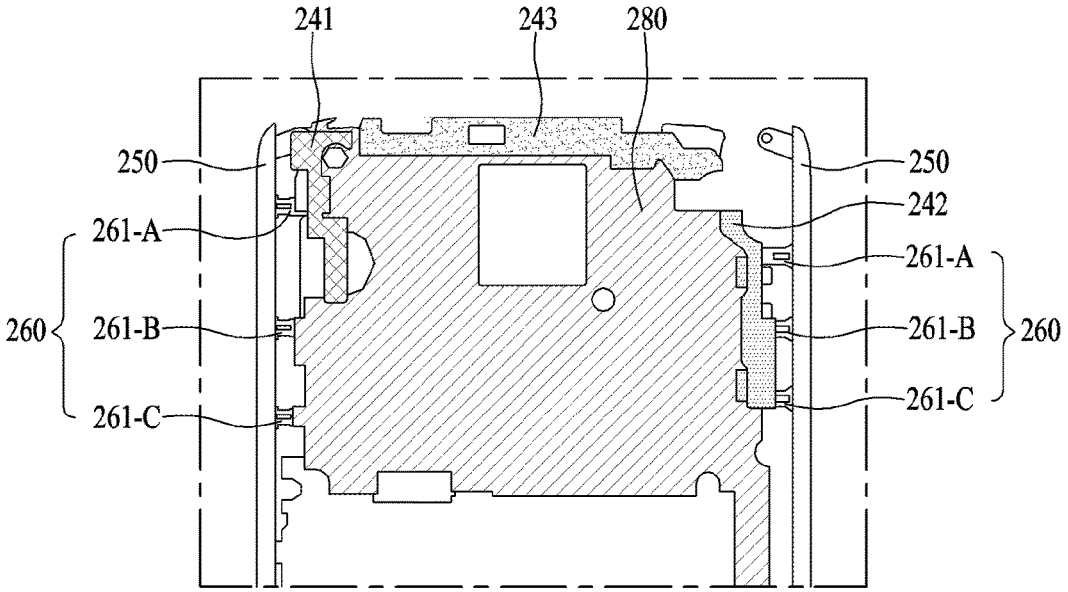
FIG. 11 is a backside diagram of a third antenna, a second antenna and a main board of a mobile terminal according to the present invention.

FIG. 11 is a backside diagram of the third antenna 250, the second antenna 240 and the main board 280 of the mobile terminal 100 according to the present invention.

Referring to FIG. 11, in case that the connecting pin 260 connects the third antenna 250 to a different antenna, possibility of extension of an antenna pattern region can be provided. On the other hand, if the connecting pin 260 is connected to the third antenna 250 and the main board 280 or the flexible board 281, it is able to play a role as a short circuit or a ground.

The main board 280 may be provided between the frame 210 and the rear case 230. Parts or components of the mobile terminal 100 can be mounted on the main board 280. In case that the main board 280 is connected to a ground part of an antenna, the main board 280 may play a role as a ground of an antenna pattern.

The connecting pin 260 electrically connects the third antenna 250 and the main board 280 to each other, thereby playing a role as a ground. The connecting pin 260 configured to play the ground role may be connected to the flexible board 281 for short circuit prevent or the like as well as to the main board 280. The main board 280 may be provided with an electric shock prevention circuit for preventing an electric shock. Through this, the connecting pin 260 configured to play the ground role can prevent an electric shock accident, which may occur if a user touches the third antenna 250 exposed out of the mobile terminal 100, and the like.

Figure 12:
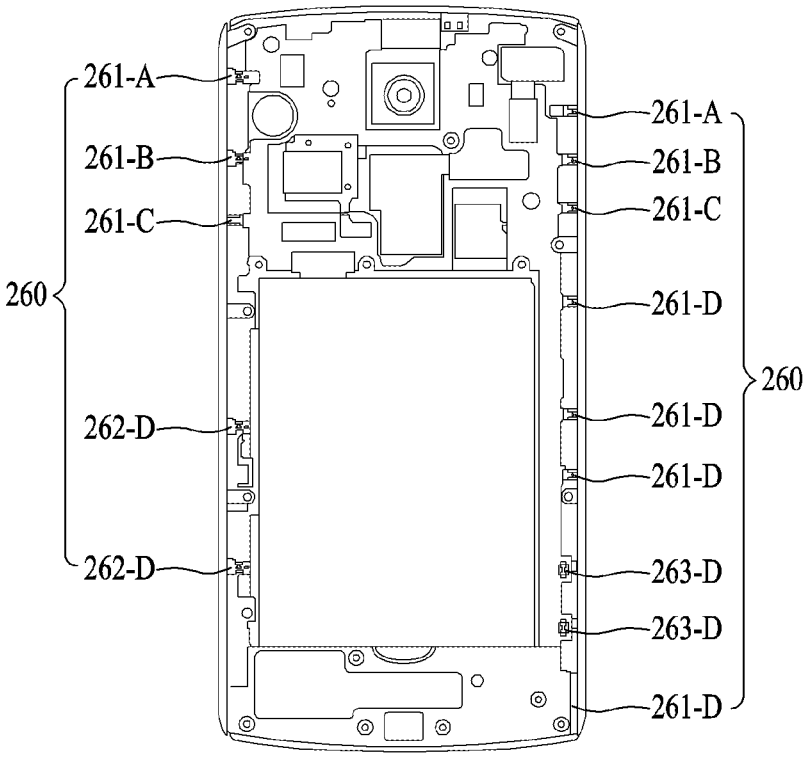
FIG. 12 is a backside diagram of a rear case removed mobile terminal according to the present invention.

The vertical connecting pin 261, the straight connecting pin 262 and the contact connecting pin 263 mentioned in the descriptions with reference to FIG. 11 and FIG. 12 can be substituted with one another in accordance with dispositions and sizes of connecting members whenever it is necessary. 'A', 'B', 'C' and 'D' behind the reference numbers indicate locations relative to antennas to distinguish functions different according to the locations relative to the corresponding antennas, respectively.

A top vertical connecting pin 261-A configured to connect the second antenna 240 and the third antenna 250 at a top portion may play a role in supplying electricity to the second antenna 240.

A middle vertical connecting pin 261-B configured to connect the third antenna 250 and the main board 280 below the top vertical connecting pin 261-A may play a role as a short circuit in adjusting a resonance length of an antenna. Hence, it is able to adjust a frequency region of each antenna in accordance with a location of the middle vertical connecting pin 261-B.

A bottom vertical connecting pin 261-C configured to connect the third antenna 250 and the main board 280 below the middle vertical connecting pin 261-B may play a role as a short circuit in preventing an isolation effect from being lowered due to resonance generated from an unintentionally generated antenna pattern parasitic on an original antenna pattern.

The middle or bottom connecting pin is able to play a short circuit role and a ground role by being connected to the main board 280 or the flexible board 281.

FIG. 12 is a backside diagram of the mobile terminal 100 having the rear case 230 removed therefrom according to the present invention.

Referring to FIG. 12, a vertical antenna 261-D, a straight antenna 262-D and a contact antenna 263-D located in a lower part of the mobile terminal 100 connect the third antenna 250 to the main board 280 or the flexible board 281, thereby playing a ground role. Theses antennas are disposed in a region having nothing to do with the second antenna 240. The reason for this is to reduce the deviation of a ground effect for each antenna pattern by intensifying the ground effect in a manner of increasing ground points.

Figure 13:
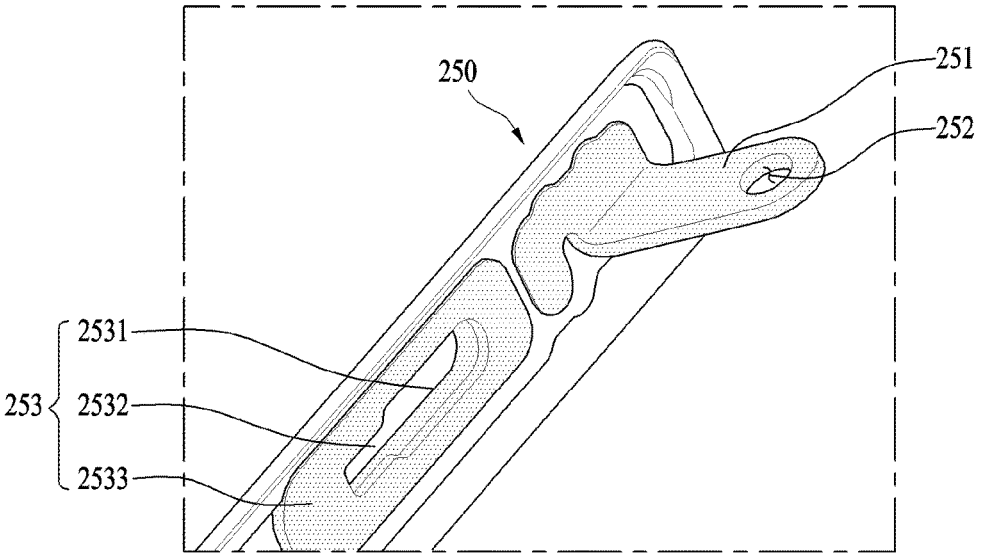
FIG. 13 is an enlarged perspective diagram of a region E shown in FIG. 4.

FIG. 13 is an enlarged perspective diagram of a region E shown in FIG. 4.

Referring to FIG. 13, it is able to use a slide lock module for the stable lock between the third antenna 250 and the frame 210.

A slide lock hole 253 may be provided to an inner lateral surface of the third antenna 250. The slide lock hole 253 may be divided into a first region 2531 having a hole in wide width and a second region 2532 having a hole in narrow width.

A hole forming member 2533 configured to form the slide lock hole 253 may be attached to the third antenna 250 by soldering.

Figure 14:
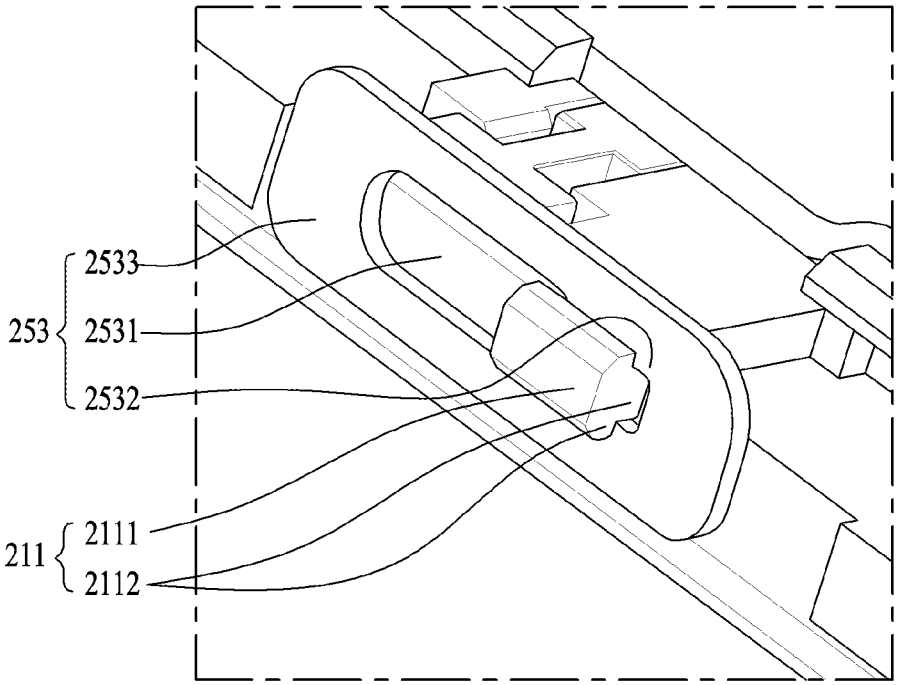
FIG. 14 is a diagram to describe one example of locking a slide lock hole in a region G shown in FIG. 4.

FIG. 14 is a diagram to describe one example of locking the slide lock hole 253 in a region G shown in FIG. 4.

Referring to FIG. 14, a projected hook part 211 corresponding to the slide lock hole 253 of the third antenna 250 may be provided to a lateral surface of the frame 210. The projected hook part 211 may include a separation preventing part 2111 located outside and a locking part 2112 located inside.

A width of the separation preventing part 2111 of the projected hook part 211 may correspond to a width of the first region 2531 of the slide lock hole 253, and a width of the locking part 2112 of the projected hook part 211 may correspond to a width of the second region 2532 of the slide lock hole 253. If the third antenna 250 slides to pass through an inner lateral surface of the frame 210, the third antenna 250 and the frame 210 can be stably locked together.

Figure 15:
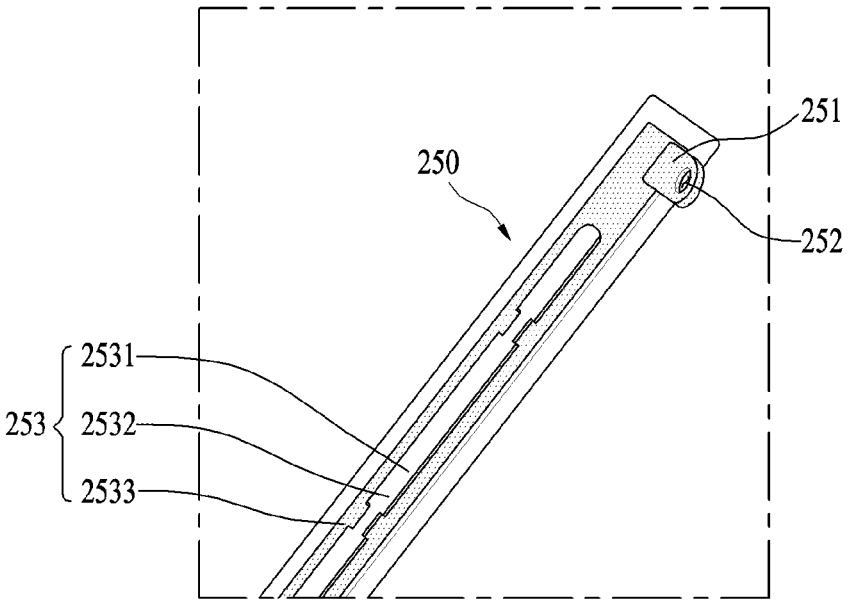
FIG. 15 is a diagram to describe another example of locking a slide lock hole in a region G shown in FIG. 4.

FIG. 15 is a diagram to describe another example of locking the slide lock hole 253 in a region G shown in FIG. 4.

Referring to FIG. 15, as the slide lock hole 253 is built in one body with the fixing part 251, it can be combined with the third antenna 250.

According to the case shown in FIG. 13, since the slide lock hole 253 and the fixing part 251 are individually combined with the third antenna 250, the increase of weight can be minimized. On the other hand, according to the case shown in FIG. 15, since the slide lock hole 253 and the fixing part 251 are fixed as a single member, it is able to reduce the manufacturing cost.

Accordingly, embodiments of the present invention are directed to a mobile terminal thereof that substantially obviates one or more problems due to limitations and disadvantages of the related art.

One object of the present invention is to provide a mobile terminal, by which extensibility of an antenna pattern and radiation efficiency of an antenna can be increased.

Another object of the present invention is to provide a mobile terminal, by which the possibility of occurrence of an electric shock or an antenna performance degradation in gripping a mobile terminal with user's fingers can be minimized.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, a mobile terminal according to one embodiment of the present invention may include a display, a frame configured to support a back of the display, a first antenna to be provided to at least one side of a top portion and a bottom portion of the frame, a rear case to attach to a back of the frame, a second antenna provided to at least one of an inner lateral side and an outer side of the rear case, and a third antenna configured in a beam shape to be attached to at least one of a right lateral side and a left lateral side of the frame, the third antenna configured to be electrically connected to either the first antenna or the second antenna.

Preferably, the second antenna may include an outer part provided at the outer side of the rear case, an inner part provided at the inner side of the rear case, and a bent part configured to connect the outer part and the inner part of the second antenna, and the rear case may include a hole to enable the bent part to pass through.

Preferably, the third antenna may further include a fixing part projected to extend from an inner lateral side by having a conductive material, and the first antenna may further include an extension part configured to contact the fixing part.

More preferably, the mobile terminal may further include a lock hole in a corresponding region of each of the fixing part and the extension part and a screw to attach to the lock hole.

Preferably, the mobile terminal may further include a connecting pin provided between the frame and the rear case, a first end portion of the connecting pin may contact an inner lateral side of the third antenna, and a second end portion of the connecting pin may contact the second antenna.

More preferably, the connecting pin may further include a metal wire having a bent terminal corresponding to each of the first end portion and the second end portion of the connecting pin.

Particularly, the connecting pin may further include a mold part configured to form an exterior frame of the connecting pin by double injection molding performed on the metal wire and the frame may include a recess part configured to enable the mold part of the connecting pin seated thereon.

Preferably, the mobile terminal may further include a main board provided between the frame and the rear case and a ground pin provided between the front case and the main board, a first end portion of the ground pin may contact an inner lateral side of the third antenna, and a second end portion of the ground pin may contact a rear surface of the main board.

Preferably, the mobile terminal may further include at least one slide lock hole configured to decrease in width by being provided to an inner lateral side of the third antenna and a projected hook part configured to couple to the third antenna by being provided to a region of a lateral surface of the frame corresponding to the at least one slide lock hole.

More preferably, the slide lock hole may be attached to the inner lateral side of the third antenna by soldering.

Accordingly, embodiments of the present invention provide various effects and/or features.

According to at least one of embodiments of the present invention, it is advantageous in that the degree of freedom of an antenna radiation pattern can be raised.

According to at least one of embodiments of the present invention, it is advantageous in that an antenna radiation gain can be raised.

Effects obtainable from the present invention may be non-limited by the above mentioned effect. And, other unmentioned effects can be clearly understood from the following description by those having ordinary skill in the technical field to which the present invention pertains.

It is to be understood that both the foregoing general description and the following detailed description of the present invention are exemplary and explanatory and are intended to provide further explanation of the invention as claimed.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

The present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

Any reference in this specification to "one embodiment," an "embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A mobile terminal, comprising:

a display;

a frame configured to support a back of the display;

a first antenna to be provided to at least one side of a top portion and a bottom portion of the frame;

a rear case to attach to a back of the frame;

a second antenna provided at both of an inner side of the rear case and an outer side of the rear case, the second antenna comprising:

an outer lateral surface part provided on the outer side of the rear case, an inner lateral part provided on the inner side of the rear case, and a bent part that connects the outer lateral surface part and the inner lateral part;

a third antenna configured in a beam shape to be attached to at least one of a right lateral side and a left lateral side of the frame, the third antenna including a fixing part projected by extending from an inner lateral surface of the third antenna; and an extension part, provided at the first antenna, electrically connected to the fixing part of the third antenna, wherein the third antenna is electrically connected to the bent part of the second antenna, wherein the third antenna includes a metal material, and wherein a portion of the third antenna is exposed to an exterior of the mobile terminal so as to form right and left lateral exterior surfaces of the mobile terminal.

2. The mobile terminal of claim 1, wherein the rear case includes a hole to enable the bent part of the second antenna to pass through.

3. The mobile terminal of claim 1, further comprising:

a lock hole in a corresponding region of each of the fixing part and the extension part; and a screw to attach to the lock hole.

4. The mobile terminal of claim 1, further comprising a connecting pin provided between the frame and the rear case, wherein a first end portion of the connecting pin contacts an inner lateral side of the third antenna, and wherein a second end portion of the connecting pin contacts the second antenna.

5. The mobile terminal of claim 4, wherein the connecting pin includes a metal wire having a bent terminal corresponding to each of the first end portion and the second end portion of the connecting pin.

6. The mobile terminal of claim 5, wherein the connecting pin includes a mold part configured to form an exterior frame of the connecting pin by double injection molding performed on the metal wire, and wherein the frame includes a recess part configured to enable the mold part of the connecting pin seated thereon.

7. The mobile terminal of claim 1, further comprising:

a main board provided between the frame and the rear case; and a ground pin provided between the front case and the main board, wherein a first end portion of the ground pin contacts an inner lateral side of the third antenna, and wherein a second end portion of the ground pin contacts a rear surface of the main board.

8. The mobile terminal of claim 1, further comprising:

at least one slide lock hole configured to decrease in width by being provided to an inner lateral side of the third antenna; and a projected hook part configured to couple to the third antenna by being provided to a region of a lateral surface of the frame corresponding to the at least one slide lock hole.

9. The mobile terminal of claim 8, wherein the slide lock hole is attached to the inner lateral side of the third antenna by soldering.

10. A mobile terminal, comprising:

a frame to support a display, the frame having a first portion, a second portion and a back portion;

a first antenna at the first portion of the frame;

a rear case at the back portion of the frame, the rear case having an inner side and an outer side;

a second antenna provided at both of an inner side of the rear case and an outer side of the rear case, the second antenna comprising:

an outer lateral surface part provided on the outer side of the rear case;

an inner lateral part provided on the inner side of the rear case; and a bent part that connects the outer lateral surface part and the inner lateral part;

a third antenna to attach to at least one lateral side of the frame, the third antenna including a fixing part projected by extending from an inner lateral surface of the third antenna; and an extension part, provided at the first antenna, electrically connected to the fixing part, wherein the third antenna is electrically connected to the bent part of the second antenna, wherein the third antenna includes a metal material, and wherein a portion of the third antenna is exposed to an exterior of the mobile terminal so as to form right and left lateral exterior surfaces of the mobile terminal.

11. The mobile terminal of claim 10, wherein the rear case includes a hole to receive the bent part of the second antenna.

12. The mobile terminal of claim 10, further comprising:

a lock hole in a corresponding region of each of the fixing part and the extension part; and a screw to be received at the lock hole.

13. The mobile terminal of claim 10, further comprising a connecting pin between the frame and the rear case, wherein a first end portion of the connecting pin contacts an inner lateral side of the third antenna, and wherein a second end portion of the connecting pin contacts the second antenna.

14. The mobile terminal of claim 13, wherein the connecting pin includes a metal wire having a bent terminal corresponding to each of the first end portion and the second end portion of the connecting pin.

15. The mobile terminal of claim 14, wherein the connecting pin includes a mold part to form an exterior frame of the connecting pin by double injection molding performed on the metal wire, and wherein the frame includes a recess part configured to enable the mold part of the connecting pin seated thereon.

16. The mobile terminal of claim 10, further comprising:

a main board between the frame and the rear case; and a ground pin between the front case and the main board, wherein a first end portion of the ground pin contacts an inner lateral side of the third antenna, and wherein a second end portion of the ground pin contacts a rear surface of the main board.

17. The mobile terminal of claim 10, further comprising:

at least one slide lock hole that decreases in width by being provided to an inner lateral side of the third antenna; and a projected hook part to couple to the third antenna by being provided to a region of a lateral surface of the frame corresponding to the at least one slide lock hole.

18. The mobile terminal of claim 17, wherein the slide lock hole is coupled to the inner lateral side of the third antenna by soldering.

* * * * *